United States Patent [19]

Flaig

[11] 4,408,899

[45] Oct. 11, 1983

[54] ELECTRONIC CLOCK STRIKING MECHANISM

[75] Inventor: Hans Flaig, Schramberg, Fed. Rep. of Germany

[73] Assignee: Gebruder Junghans GmbH, Schramberg, Fed. Rep. of Germany

[21] Appl. No.: 285,799

[22] Filed: Jul. 22, 1981

[30] Foreign Application Priority Data

Sep. 3, 1980 [DE] Fed. Rep. of Germany ..... 3033087

[51] Int. Cl.[3] ..... G04B 21/00

[52] U.S. Cl. ..... 368/273; 368/9; 368/10

[58] Field of Search ..... 368/10, 68, 272, 273, 368/274

[56] References Cited

U.S. PATENT DOCUMENTS 3,420,051 1/1969 Matteson ..... 368/63

4,326,276 4/1982 Scott, Jr. ..... 368/273

*Primary Examiner*—Bernard Roskoski

*Attorney, Agent, or Firm*—Burns, Doane, Swecker & Mathis

[57] ABSTRACT

Additional fields of application are provided for an electronic clock striking mechanism. In particular, a modular unit for a clock striking mechanism comprising an operating device, together with a clock circuit, and optionally a battery space, is built into a living room phono installation and connected by means of a selector circuit with a speaker. This arrangement makes possible the emission of acoustic time information synchronously with the time display of quartz-stabilized living room clocks that are potentially present, without the need for synchronization with the clock circuit in the clock striking mechanism which is also stabilized by quartz vibrations.

5 Claims, 2 Drawing Figures

ELECTRONIC CLOCK STRIKING MECHANISM

BACKGROUND OF THE INVENTION

The present invention relates to a clock striking mechanism for sounding a chime or melody at predetermined times, and more particularly to an electronic clock striking mechanism of the type having a detecting circuit for actuating a transducer circuit to generate an acoustic time signal through a speaker upon occurrence of a predetermined time signal.

A device of this generic type, which replaces the conventional mechanical or electromechanical chime or melodious striking mechanisms with means for the electronic synthesis of sound, to thereby produce a sound to be emitted over a loudspeaker, is disclosed in United Kingdom patent application published No. 20 356 24. This device is intended for installation in analog clocks which have no timekeeping circuit in their own mechanism. In this device, the stepping motor that drives the hand means of the analog clock, by way of gear means, is actuated by a digital timekeeping circuit which also controls the emission of sound in the electronic striking mechanism.

The present invention is based on the fact that at the present time an average household can be expected to be equipped with an adequate number of clocks, especially in the living area, wherefore there is no real need for the acquisition of another clock, even though it might be the first to be equipped with a striking mechanism. Additionally, for reasons of production costs, only a limited model offering of clocks for living areas with electronic striking mechanisms can be realistically expected, so that finding an additional clock that would fit into an existing decorating scheme may be difficult.

In view of these facts, it is the primary object of the invention to open up further fields of application for standardized electronic clock striking mechanisms to make possible the mass production of the latter, thereby reducing costs.

SUMMARY OF THE INVENTION

This object is attained with an electronic clock striking mechanism, of the abovementioned generic type, that is incorporated into a pre-existing loudspeaker housing for a diverse element, such as that for a phonograph or stereo system, and is connected to the speaker housed therein.

The incorporation of a standardized electronic circuit for the acoustic indication of clock time into loudspeaker housings, such as those commercially available in the form of speaker boxes separately placeable and in particular connectable in pairs to stereo amplifiers, opens up broad additional markets, corresponding to the large phono market, for such striking mechanisms. The desirability of such an arrangement may even be increased since the time dependent emission of melodies through a phono loudspeaker box provides a much higher quality of sound than the emission through a small speaker built into the housing of a clock. The concept of the invention is additionally based on the recognition that because of the quartz controlled, time dependent actuation of the emission of acoustic time information, the absence of synchronization with other clocks independently operating in the same room would not be particularly annoying, since at the present time as a rule, all of the other clocks are generally also quartz clocks and therefore, due to their high accuracy, e.g. losing or gaining less than one minute per year, no asynchronism between the acoustic and optical time display might be expected.

Further, the incorporation of a digital time display unit in the speaker housing of a diverse element requires no additional expenditure, since the timekeeping circuit, including the decoder for the time display, is available within the circuit arrangement for the time dependent actuation of the emission of acoustic information. This further provision of one of the loudspeaker boxes of a pair of boxes of a stereo installation with digital time display may be additionally useful as a sales argument, wherein such a time display has the further advantage of making possible optical observation during the setting of time over a control range, for example during the transition from summer to winter time, thereby preventing incorrect adjustments.

Furthermore, a sensor circuit for disconnecting the sound transducer from the speaker when the speaker is broadcasting musical or vocal information, for example, provides the advantage of insuring with simple means that the musical or oral presentations over the phono installation will not be disturbed by the emission of acoustic time information.

A time dependent switching process for the sensor circuit insures that even during short interruptions of musical or oral programs there will be no emission of acoustic time information, which again could interfere with the reproduction of sound offered by the stereo installation.

If the radio receiver or a similar phono installation is equipped for the continuous determination of time with a device such as, for example, an independent or grid frequency actuated timer, in a further embodiment the corresponding clock circuit within the electronic circuit for the acoustic display of clock time (herein generally designed as the electronic striking mechanism) may be eliminated.

Further characteristics and advantages of the invention will become apparent from the following description of a preferred embodiment of the invention, whose essential features are illustrated in the drawings.

DETAILED DESCRIPTION

Figure 1:
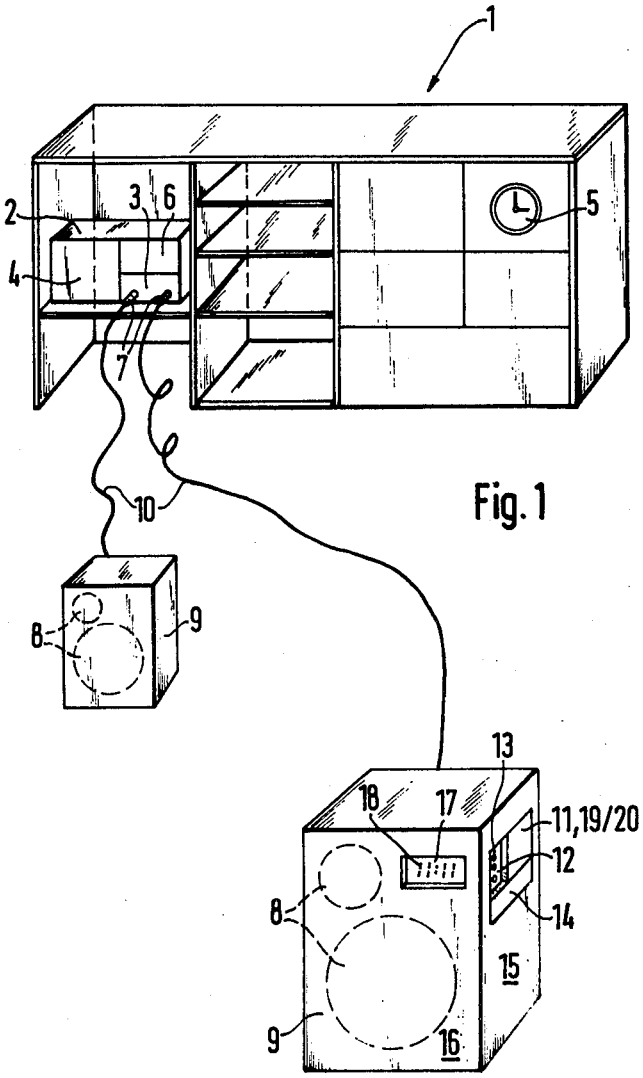
FIG. 1 is a schematic diagram of a home stereo installation with the inclusion of a control device for an electronic time striking mechanism in one of the speaker housings.

In the embodiment shown in FIG. 1, an item of living room furniture 1, for example a wall unit, houses a diverse element such as a phono apparatus 2 with an amplifier 3 and a control unit 4. A quartz living room clock 5 is further shown. The clock operates independently, i.e., with its own source of power in the form of a battery, and is not a part of the phono apparatus 2. A plurality of additional quartz clocks (e.g., wall, standing and/or table clocks) may be operating in the same room, which, by virtue of the high accuracy of quartz stabilized clock control circuits, run practically in a synchronous manner, even though they are not synchronized with each other. The phono apparatus 2 itself may also be equipped with a battery powered quartz clock or a grid timed clock, for example with a digital display, which serves as a timer 6.

In the case of the illustrated embodiment, the amplifier 3 has outlets 7 for the stereophonic actuation (shown in FIG. 1 with a single pole) of the speakers 8. The speakers are arranged in speaker housings 9 that may be placed separately and are connected with the amplifier outlets 7 by means of speaker lines 10.

A mechanism 11, designated as the clock striking mechanism, is bulit into one of the speaker housings 9, preferably in the manner described in more detail in the above-cited British Publication No. 20 35 624 with respect to the storage and time actuated callup of characteristic values for partial melody sequences to be generated electronically and emitted electromechanically. The circuit of this electronic striking mechanism 11 is connected to a control device 12, containing the switches 13 for the selection of one or more melodies and for the synchronizatin of the actuation of the striking mechanism (actuation of the characteristic time marking melodies), as also described in more detail in the above-cited patent publication. A battery space 14 is further built into the speaker housing in which the striking mechanism 11 is incorporated. The battery space is accessible from the outside, for example by the opening of a cover, if a power source is not already available in the speaker housing 9, as for example in the so-called "active" boxes. While these additional, manually actuated installations are arranged preferably on a rear or lateral wall 15, the front side 16 of the speaker housing 9 may further contain a time clock display 17, for example with a digital display 18. Finally, depending on the conditions of the actuation of the speakers 8 by the amplifier 3, it may be convenient or even necessary to provide in the amplifier 3 or in the speaker housing 9 a sensor circuit 19 for a selector circuit 20 (FIG. 2).

Figure 2:
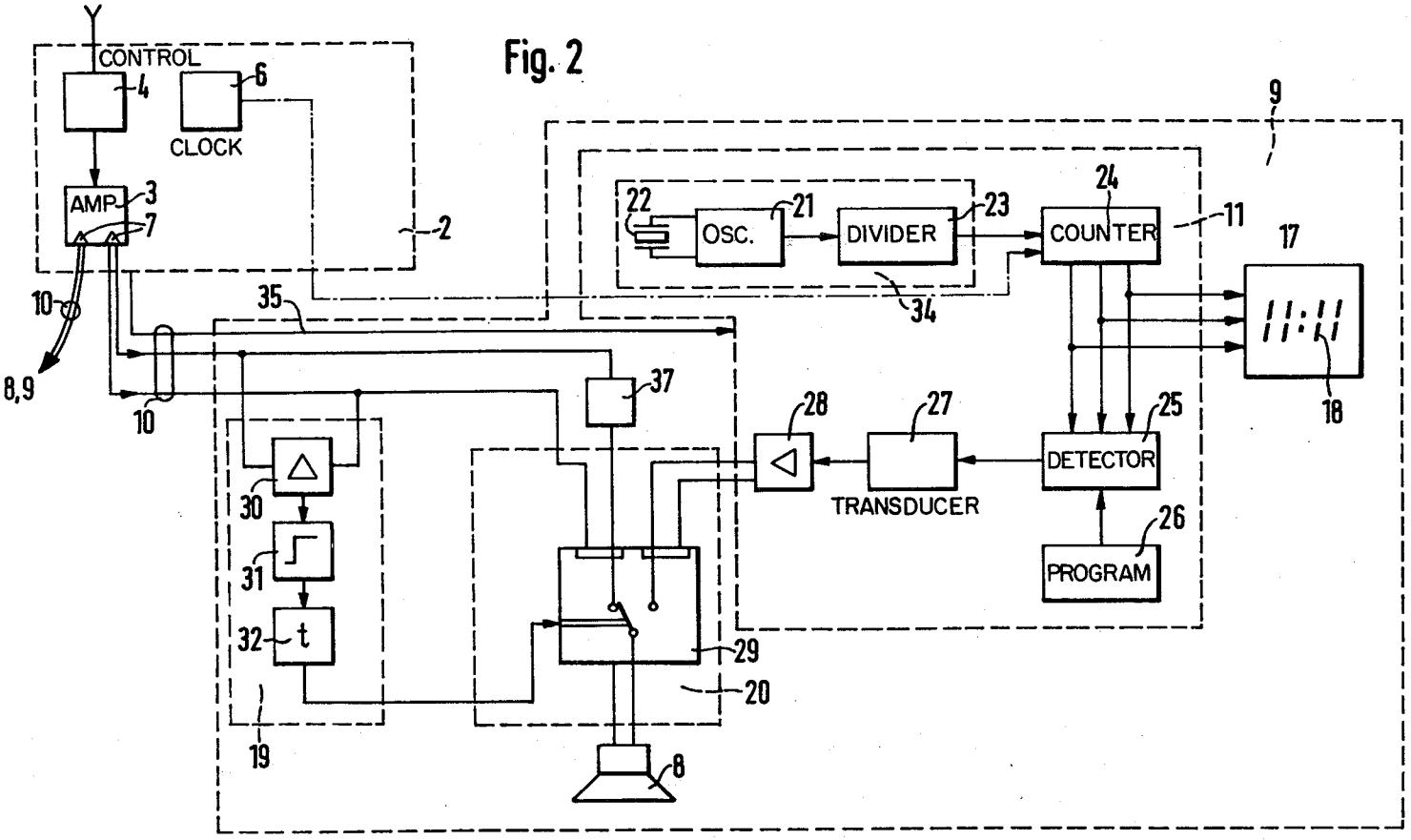
FIG. 2 is a schematic circuit diagram of the speaker control circuit in the speaker housing.

As shown in more detail in FIG. 2, the circuit of the electronic clock striking mechanism 11 in the usual case consists of a timekeeping oscillator circuit 21 with an oscillator quartz 22 to stabilize the oscillating frequency. The output frequency is divided in a number of divider stages 23 to a low frequency signal for the actuation of a time counter 24. The signals representing the instantaneous clock time may appear at the output terminals of the counter, for example, for the actuation of the display 18 of a digital clock time display 17 (FIG. 1).

The output signals of the time counter 24 are also fed to a detecting circuit 25, which actuates a signal transducer 27 at points in time determined by a program transducer 26, for example every quarter hour, to generate an acoustic characteristic clock time signal in the form of a strike tone sequence or a melody. The transducer in turn actuates the speaker 8 by means of a terminal amplifier stage 28, to emit this clock time information acoustically.

Conveniently, the selector circuit 20 is provided between the electronic striking mechanism 11 and the speaker 8. The selector circuit is shown in the example of FIG. 2 as an electromechanical selector switch 29, in order to simplify the representation of its function, while in actual practice it can be designed in the form of an electronic gate circuit. The selector switch 29 separates the actuating mechanism of the speaker 8 from the terminal stage 28 of the signal transducer during the operation of the amplifier 3 for the emission of a musical or oral presentation, so that the latter will not be disturbed by an acoustic time signal. For this purpose, the speaker 8 is connected by means of the selector circuit 20 with the outlet of the terminal stage 28 of the time signal transducer 27 only when it has been determined, by means of a sensor circuit 19, that there has been no actuation of the speaker by the amplifier 3, through the line 10, over a predetermined period of time. To accomplish this, the sensor circuit 19 includes a differential amplifier 30 supplied with a signal through both conductors of the speaker line 10. The differential amplifier actuates a threshold value stage 31 in the presence of an audio signal on the pair of conductors of the line 10. If, however, the output signal of the latter is absent over a given period of time, a subsequent time stage 32 is activated, to connect the speaker 8 with the terminal stage 28 of the striking mechanism. In other words, following a certain rest period after an oral or musical presentation over the speaker 8, the latter again becomes available for the emission of acoustic time information, in particular for the emission of chime sounds and/or melodies, or, with a suitable type of signal transducer 27, for the emission of stored or synthetically generated verbal time information.

If the phono apparatus 2 is equipped with an electronic clock, such as a timer 6 for the selective actuation of a receiver at a given point in time, the monitoring of the clock circuit 34 of the electronic strike mechanism 11 by the differnece circuit 25 may be eliminated, provided that a time count cycle is transmitted from the timer 6 to the time counter 24, as indicated in principle by the dash-dot line in FIG. 2. Alternatively, the entire clock circuit 34 can be eliminated.

If the speaker line 10 has more than two conductors, the supply of power for the operation of the circuit of the electronic strike mechanism 11 may be effected over the speaker line, so that it is not necessary to provide and equip a special battery space 14 (FIG. 1) in the speaker housing 9. In the case of the example of FIG. 2, the line 10 is equipped for this purpose with an additional supply conductor 35.

The present invention may be embodied in other specific forms without departing from the spirit or essential characteristics thereof. The presently disclosed embodiment is therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. In an electronic clock striking mechanism having a control circuit including a detector for detecting a real-time related signal and a signal transducer circuit which is actuated to produce an acoustic time indication in response to detection of a predetermined time signal, the improvement wherein said control circuit is built into a loudspeaker housing for a conventional diverse element commonly found in a dwelling and is operatively connected to a speaker in said housing to emit the acoustic time indication through said speaker upon actuation of said signal transducer circuit, and further including a sensor circuit for sensing a signal from said diverse element and for selectively disconnecting said signal transducer circuit from said speaker when a signal is sensed.

2. The electronic clock striking mechanism of claim 1 wherein said loudspeaker housing also incorporates a counter for producing said real-time related signal in response to a timing signal, and a time clock including a digital display unit, said time clock being connected to said counter in parallel with said detector.

3. The electronic clock striking mechanism of claim 1 wherein said sensor circuit includes a time delay stage for maintaining said signal transducer circuit disconnected from said speaker a predetermined time period after a signal is sensed.

4. The electronic clock striking mechanism of claim 1 wherein said diverse element is a phono system.

5. The electronic clock striking mechanism of claim 4 wherein said phono system includes a clock, and a timing signal from said clock is supplied to said striking mechanism control circuit.

* * * * *